US010591152B2

(12) United States Patent
Long et al.

(10) Patent No.: US 10,591,152 B2
(45) Date of Patent: Mar. 17, 2020

(54) LED LAMP

(71) Applicant: Current Lighting Solutions, LLC, East Cleveland, OH (US)

(72) Inventors: Qi Long, ShangHai (CN); Min Fang, ShangHai (CN); Zhu Mao, ShangHai (CN); Shuyi Qin, ShangHai (CN); Yong Li, ShangHai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/017,701

(22) Filed: Jun. 25, 2018

(65) Prior Publication Data

US 2019/0032910 A1 Jan. 31, 2019

(30) Foreign Application Priority Data

Jul. 26, 2017 (CN) ..... 2017 1 0617631

(51) Int. Cl.
*F21V 29/67* (2015.01)
*F21V 29/503* (2015.01)
(Continued)

(52) U.S. Cl.
CPC ..... *F21V 29/673* (2015.01); *F21K 9/238* (2016.08); *F21V 29/503* (2015.01);
(Continued)

(58) Field of Classification Search
None
See application file for complete search history.

(56) References Cited

U.S. PATENT DOCUMENTS 7,661,854 B1 * 2/2010 Yang ..... F21K 9/00 362/373
7,748,870 B2 * 7/2010 Chang ..... F21V 29/004 362/294
(Continued)

FOREIGN PATENT DOCUMENTS

CN 202834874 U 3/2013
CN 204554408 U 8/2015

OTHER PUBLICATIONS

Chinese Office Action dated Nov. 5, 2019 which was issued in a counterpart Chinese Application No. 201710617631.1 which was filed Jul. 26, 2017.

*Primary Examiner* — Elmito Breval
(74) *Attorney, Agent, or Firm* — Buckley, Maschoff & Talwalkar LLC

(57) ABSTRACT

The present invention relates to a light emitting diode (LED) lamp, which includes: a base configured to electrically connect with an external power supply; at least one first printed circuit board (PCB), with at least one LED mounted thereon; a driver module, electrically connected to the base and the first PCB, and configured to drive an LED; a heat dissipation module, thermally contacted with the first PCB, and configured to dissipate heat generated from the LED; a connecting device, connected to the heat dissipation module; and a replaceable active cooling module, detachably connected to the connecting device, and configured to generate a cooling fluid for cooling at least one of the PCB and the heat dissipation module.

9 Claims, 5 Drawing Sheets

(51) Int. Cl.

| | |
|---|---|
| ***F21V 29/508*** | (2015.01) |
| ***F21K 9/238*** | (2016.01) |
| *F21V 23/04* | (2006.01) |
| *F21Y 107/30* | (2016.01) |

(52) U.S. Cl.
CPC ..... *F21V 29/508* (2015.01); *F21V 23/0442* (2013.01); *F21Y 2107/30* (2016.08)

(56) References Cited

U.S. PATENT DOCUMENTS

| | | | | |
|---|---|---|---|---|
| 8,403,541 | B1 * | 3/2013 | Rashidi | F21S 8/026 257/712 |
| 2010/0109499 | A1 * | 5/2010 | Vilgiate | F21V 3/00 313/1 |
| 2010/0164348 | A1 * | 7/2010 | Huang | F21V 15/01 313/46 |
| 2010/0165632 | A1 * | 7/2010 | Liang | F21V 3/00 362/294 |
| 2011/0037368 | A1 * | 2/2011 | Huang | F21V 29/02 313/46 |
| 2011/0089830 | A1 * | 4/2011 | Pickard | F21V 29/54 315/32 |
| 2011/0109216 | A1 * | 5/2011 | Kang | F21V 29/004 313/45 |
| 2014/0204584 | A1 * | 7/2014 | Wu | F21V 29/74 362/294 |

* cited by examiner

LED LAMP

TECHNICAL FIELD

THE PRESENT APPLICATION RELATES TO a light emitting diode (LED) lamp, and in particular, to an LED lamp having a replaceable active cooling module.

BACKGROUND

As a new-generation light source, an LED has the advantages of energy saving, environmental protection, long life, diversified colors, stable beam, and high electro-optical conversion rate. It has become a trend to use the LED as a lighting source in recent years.

When an LED is used to improve a conventional high-intensity discharge (HID) lamp that requires high light intensity, an active cooling device is indispensable because a high-power light emitting element generates a lot of heat and the outdoor environment is rather bad. Use of a cooling fan is a currently popular active cooling method that has high efficiency and low costs, which has been widely applied in various products. However, during use of the lamp, the high temperature produced by the closed environment, and moisture and dust in the environment may both dramatically reduce the service life of the fan, thereby further reducing the service life of the whole lamp.

Therefore, it is necessary to provide a solution to better solve the cooling problem of the lamp without a change to a principal structure of the lamp.

SUMMARY OF THE INVENTION

The present application provides an LED lamp. The LED lamp includes: a base configured to electrically connect with an external power supply; at least one first printed circuit board (PCB), with at least one LED mounted thereon; a driver module, electrically connected to the base and the first PCB, and configured to drive the LED; a heat dissipation module, thermally contacted with the first PCB, and configured to dissipate heat generated from the LED; a connecting device, connected to the heat dissipation module; and a replaceable active cooling module, detachably connected to the connecting device, and configured to generate a cooling fluid for cooling at least one of the PCB and the heat dissipation module.

One of objectives of the present application is to design a replaceable active cooling module, so that only an active cooling device, rather than the whole lamp, needs to be replaced when the service life of the active cooling device is reached, thus reducing the costs.

BRIEF DESCRIPTION OF THE DRAWINGS

Embodiments of the present application are described with reference to the accompanying drawings, so that the present invention can be better understood. In the accompanying drawings.

DETAILED DESCRIPTION

Unless defined otherwise, the technical terms or scientific terms used herein should have ordinary meanings construed by those of ordinary skill in the art to which the present application belongs. The "first", "second" and similar words used in the patent specification and claims of the present invention do not denote any order, quantity or importance, but are merely intended to distinguish between different constituents. Similarly, the terms "one", "a", and similar words are not meant to be limiting, but rather denote the presence of at least one. "Comprising", "consisting", and similar words mean that elements or articles appearing before "comprising" or "consisting" include the elements or articles and their equivalent elements appearing behind "comprising" or "consisting", not excluding any other elements or articles. "Connected", "coupled" and similar words are not restricted to physical or mechanical connections, but may include electrical connections, whether direct or indirect.

Figure 1:
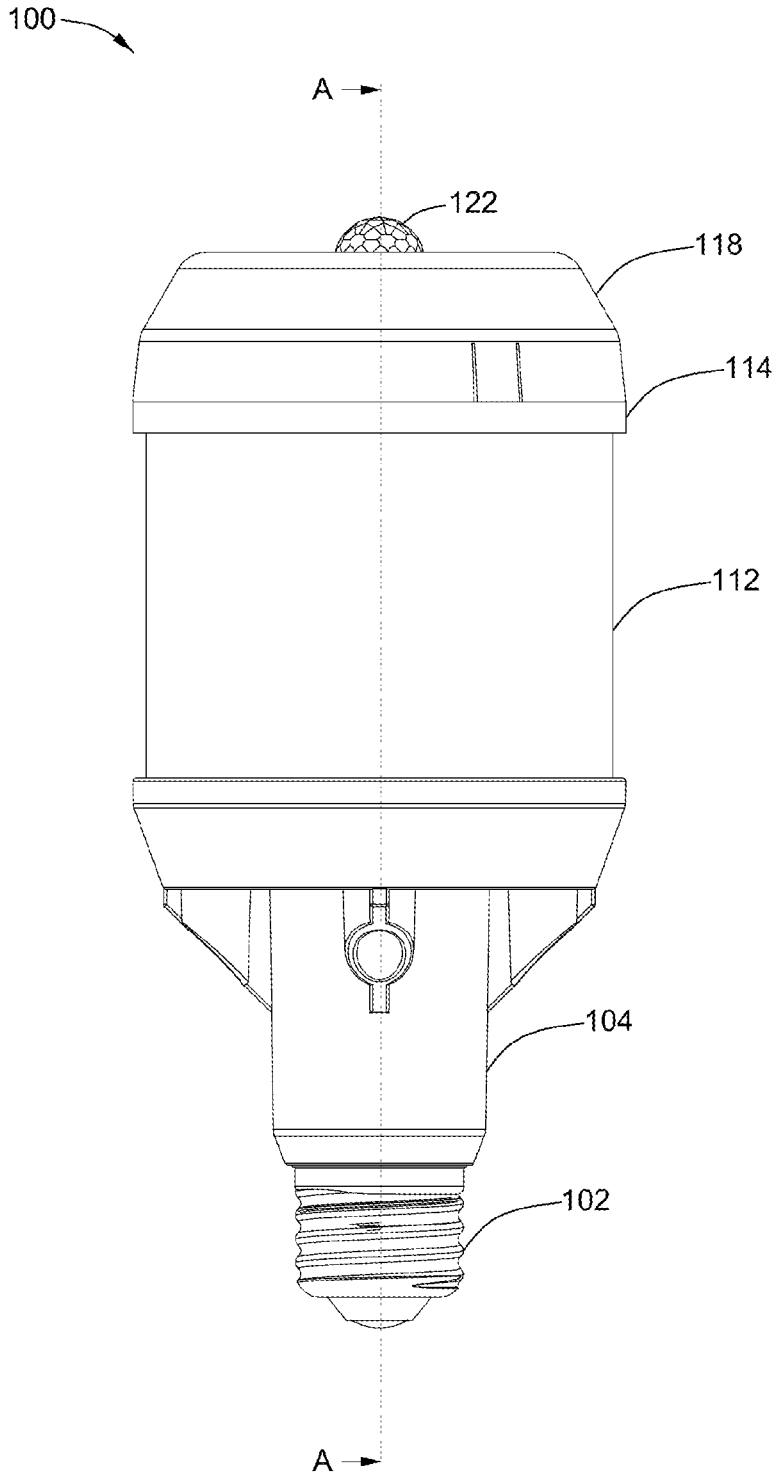
FIG. 1 is a front view of an embodiment of an LED lamp of the present invention.
Figure 2:
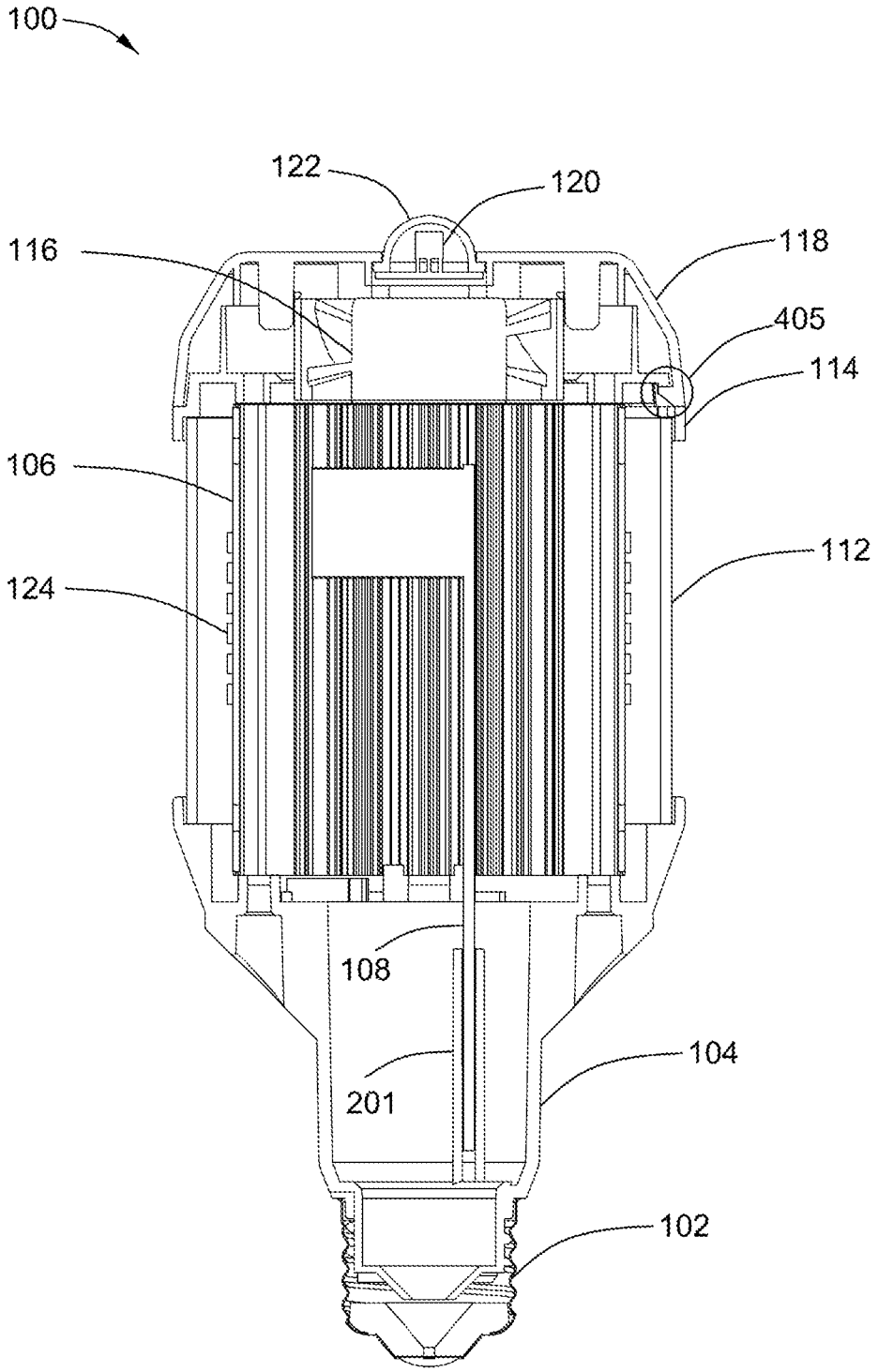
FIG. 2 is a sectional diagram of the LED lamp shown in FIG. 1 along a line A-A.
Figure 3:
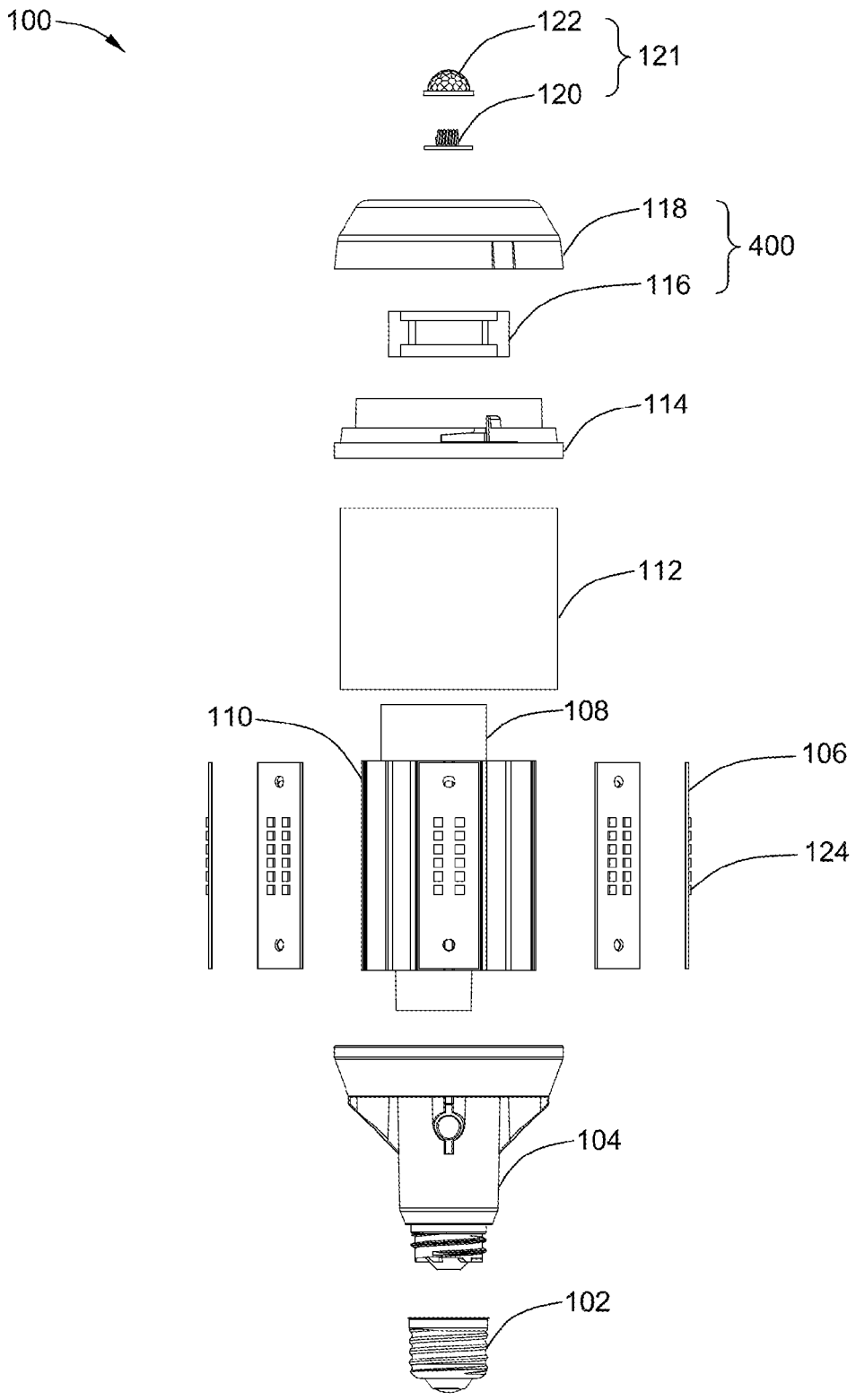
FIG. 3 is an exploded diagram of the LED lamp shown in FIG. 1.

FIG. 1 is a front view of an embodiment of an LED lamp 100 of the present invention. FIG. 2 is a sectional diagram of the LED lamp 100 shown in FIG. 1 along a line A-A. FIG. 3 is an exploded diagram of the LED lamp 100 shown in FIG. 1.

As shown in FIGS. 1, 2, and 3, the LED lamp 100 includes a base 102, a base housing 104, at least one first PCB 106, a driver module 108, a heat dissipation module 110, a lamp housing 112 (which may be made of plastic), a connecting device 114, a replaceable active cooling module 400, a fixing device 120, and a control module 121. The replaceable active cooling module 400 includes an active cooling device 116 and a cover 118.

In this embodiment, the base 102 is constructed in a conventional threaded manner, and has a standard size and structure, so that the LED lamp 100 can be mounted in a conventional lamp holder or socket to electrically connect with an external power supply. One end of the base housing 104 is in threaded connection with the base 102, and the other end thereof is securely connected to the first PCB 106, the driver module 108, the heat dissipation module 110, and the lamp housing 112. The driver module 108 is mounted in a clamping slot 201 of the base housing 104, is electrically connected to the base 102 and the first PCB 106, and is configured to drive an LED 124. The heat dissipation module 110 is fixed between the base housing 104 and the connecting device 114 with a screw, clip, or adhesive. The first PCB 106 is arranged around the heat dissipation module 110. In some embodiments, the LED lamp 100 includes eight separated first PCBs 106 that are fixed on the heat dissipation module 110 with screws. In other embodiments, the quantity of the first PCBs 106 may be adjusted according to different illumination requirements. The first PCB 106 may be fixed to the heat dissipation module 110 in other manners known to persons skilled in the art, for example, use of adhesive. Each first PCB 106 has at least one LED 124 mounted thereon. In some embodiments, each first PCB 106 has ten LEDs 124 mounted thereon. In other embodiments, the quantity of the LEDs is not limited thereto. The heat dissipation module 110 is thermally contacted with the LED 124 via the first PCB 106, and is configured to dissipate heat generated from the LED. The heat dissipation module 110 may be of any shape, including a planar shape or cylindrical shape. The first PCB 106 and the heat dissipation module 110 are matched in shape.

Figure 5:
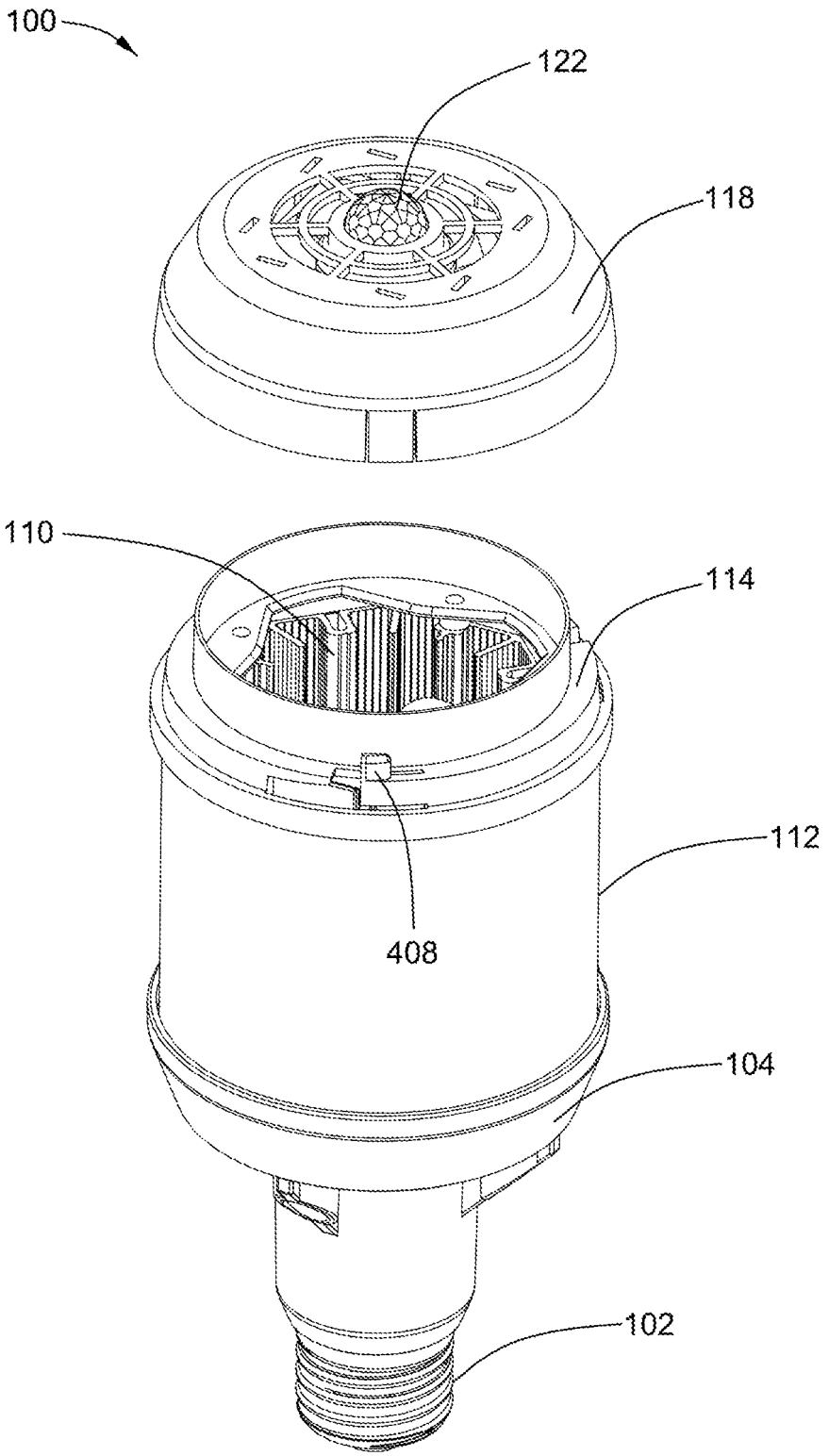
FIG. 5 is a three-dimensional diagram of the LED lamp shown in FIG. 1.

Continuously referring to FIG. 2 and FIG. 5, FIG. 5 is a three-dimensional diagram of the LED lamp 100 shown in FIG. 1, where the replaceable active cooling module 400 is detached from the connecting device 114. In this embodiment, the connecting device 114 is fixed to the heat dissipation module 110 with a screw, clip, or adhesive. Such a connection manner is rather secure, and during connection or separation, no damage is caused to the first PCB 106 and the lamp housing 112 arranged between the base housing 104 and the connecting device 114. In some embodiments, the lamp housing 112 is roughly in the shape of a cylinder, such that the heat dissipation module 110 and the first PCB 106 can be at least partially accommodated inside the lamp housing 112.

Figure 4:
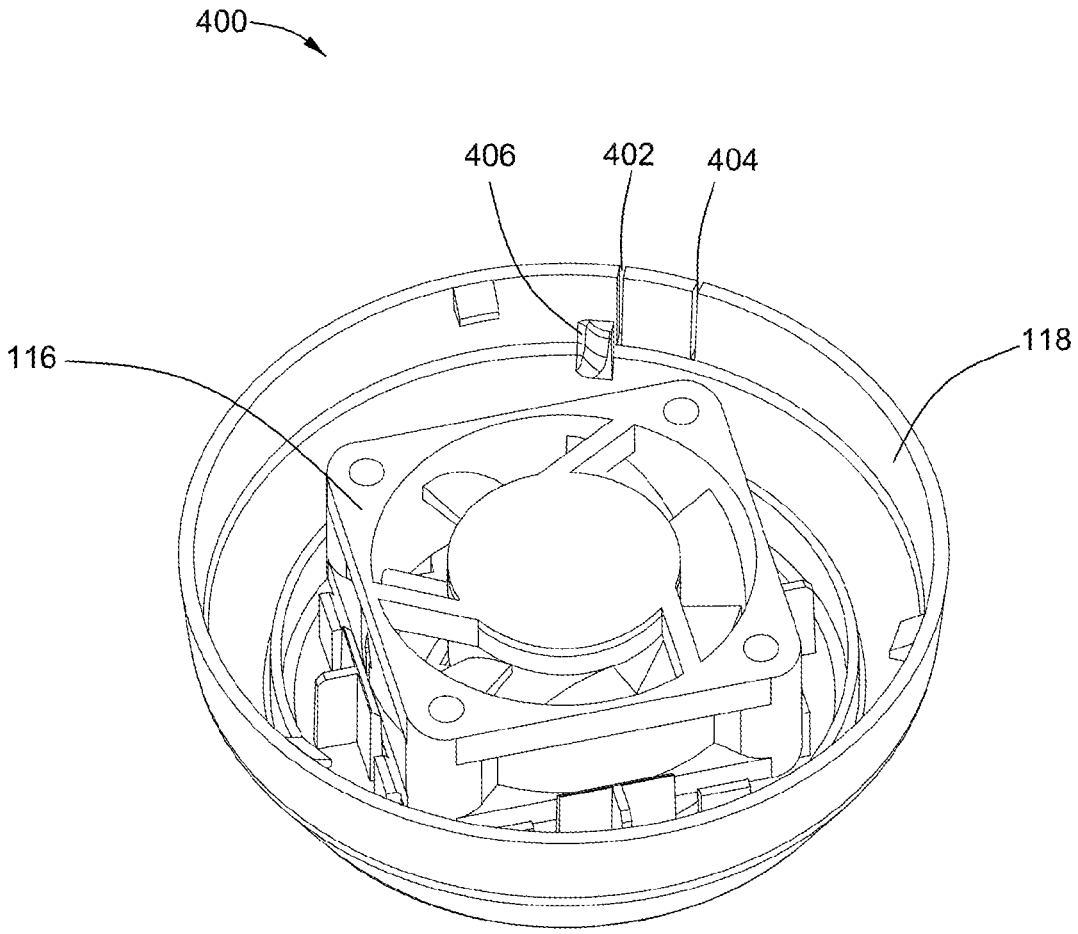
FIG. 4 is a three-dimensional diagram of an embodiment of a replaceable active cooling module in the LED lamp shown in FIG. 3.

FIG. 4 is a three-dimensional diagram of an embodiment of a replaceable active cooling module 400 in the LED lamp 100 shown in FIG. 3. As shown in FIG. 4 and FIG. 5, the replaceable active cooling module 400 includes an active cooling device 116 and a cover 118. The replaceable active cooling module 400 is detachably connected to the connecting device 114, and configured to cool at least one of the first PCB 106 and the heat dissipation module 110. Specifically, the active cooling device 116 in the replaceable active cooling module 400 generates a cooling fluid, and makes the cooling fluid flow through the first PCB 106 and the heat dissipation module 110, to take away heat. The cooling fluid may be air or other fluids. In some embodiments, the active cooling device 116 is a fan. The fan is secured with a screw and is at least partially accommodated in the cover 118. The fan delivers air to the heat dissipation module to cool the LED, thus prolonging the service life of the LED lamp 100. In other embodiments, the active cooling device 116 may be an air jet pump or a jet cooler. The active cooling device 116 and the cover 118 may also be connected with an adhesive, clamping slot, clip, or the like, in addition to the screw.

As shown in FIGS. 2, 4 and 5, the cover 118 of the replaceable active cooling module 400 is detachably connected to the connecting device 114 through at least one connection type selected from a clip connection, a thread connection, a screw connection and an interference fit connection. In this embodiment, the cover 118 and the connecting device 114 are connected through a clip structure 405. The clip structure 405 includes: a first clamping slot 402, a second clamping slot 404, and a stopper 406 that are arranged on the cover 118; and a fixture block 408 arranged on the connecting device 114, where the thickness of the fixture block 408 is gradually reduced in a counterclockwise direction. During assembly, after the connecting device 114 is covered with the cover 118, the cover 118 is turned counterclockwise to secure the fixture block 408 between the first clamping slot 402 and the second clamping slot 404 via the stopper 406, so that the replaceable active cooling module 400 and the connecting device 114 can be rapidly and securely joined together.

During use of the LED lamp, high temperature or a bad environment may reduce the service life of the active cooling device 116. In this case, the replaceable active cooling module 400 can be conveniently and rapidly detached and replaced without the need of replacing the whole LED lamp, thus greatly reducing the costs. During separation in this embodiment, the cover 118 is turned clockwise to make the fixture block 408 slide out of the first clamping slot and the second clamping slot, and then the cover 118 is raised, so that the replaceable active cooling module 400 and the connecting device 114 are rapidly separated.

In some embodiments, to realize multi-angle illumination, the LED lamp 100 also includes at least one second PCB arranged and fixed between the active cooling device 116 and the cover 118, where the second PCB has at least one LED mounted thereon. To achieve as many illumination functions as possible, a top plate of the cover 118 may be a pierced shape, or may be made of a transparent/semitransparent material.

In some embodiments, as shown in FIG. 2 and FIG. 3, the LED lamp 100 also includes at least one control module 121 detachably fixed to the cover 118, where the control module 121 includes a sensor 120 and a top cap 122. The sensor includes at least one of a solar sensor, a motion sensor, a human sensor, an acoustic sensor, a temperature sensor, a humidity sensor, an air quality sensor and a wireless module.

In this embodiment, the driver module 108 is electrically connected to the base 102 via the base housing 104. The driver module 108 is electrically connected to the first PCB 106, so as to drive the LED 124 to emit light. The active cooling device 116 of the replaceable active cooling module 400 is electrically connected with the first PCB 106 through a second electrical connector (not shown). For ease of rapid connection or separation of the replaceable active cooling module 400, the second electrical connector is selected from detachable electrical connectors, such as connectors with wiring terminals, wire nuts, or other rapidly detachable wire-to-wire connectors. In some embodiments, the second PCB is electrically connected to the first PCB 106 through a first electrical connector. The first electrical connector is selected from detachable electrical connectors, such as connectors with wiring terminals, wire nuts, or other rapidly detachable wire-to-wire connectors. The first electrical connector may be or may not be identical with the second electrical connector. In some embodiments, the control module 121 may be electrically connected to the active cooling device 116 or the second PCB, or a detachable wireless power apparatus such as a button cell may be used.

Methods for assembling and replacing the LED lamp 100 having a replaceable active cooling module 400 are described below with reference to FIG. 3 to FIG. 5.

An assembly process is as follows:

For main parts of the LED lamp 100 that are the base 102, base housing 104, at least one first PCB 106, driver module 108, heat dissipation module 110, and lamp housing 112, assembly steps thereof may be performed according to general steps of assembling an LED lamp, which are not limited herein.

The connecting module 114 is mounted on the heat dissipation module 110.

The active cooling device 116 is mounted and at least partially accommodated in the cover 118. In some embodiments, before mounting of the active cooling device 116, the control module 121 is first mounted on the cover 118 and an electrical connection is correspondingly established. In some embodiments, before mounting of the active cooling device 116, the second PCB is fixed between the cover 118 and the active cooling device 116.

The active cooling device 116 is electrically connected to the first PCB 106 through a second electrical connector. In some embodiments, the second PCB is electrically connected to the first PCB through a first electrical connector.

After the connecting device 114 is covered with the cover 118, the cover 118 is turned counterclockwise to secure the fixture block 408 between the first clamping slot 402 and the second clamping slot 404 via the stopper 406, so that the replaceable active cooling module 400 and the connecting device 114 can be rapidly and securely joined together.

If it is required to replace the active cooling device 116, a specific process is as follows:

The cover 118 is turned clockwise to make the fixture block 408 slide out of the first clamping slot and the second clamping slot, and then the cover 118 is slightly raised.

The second electrical connector is taken down from the active cooling device 116, and an electrical connection between the active cooling device 116 and the first PCB 106 is cut off. In some embodiments, the first electrical connector is taken down from the second PCB, and an electrical connection between the second PCB and the first PCB 106 is cut off.

The foregoing steps D and E are repeated for a new replaceable active cooling module 400, to complete replacement. In some embodiments, if only the active cooling device 116 needs to be replaced, it is required to detach the active cooling device 116 from the cover 118, and then repeat the foregoing steps C, D, and E, to complete replacement.

The replaceable active cooling module of the present application may also be applied, in addition to the HID lamp replaced with LEDs and described in the present application, in other types of lamps, for example, an LED lamp, a conventional HID arc lamp, a compact fluorescent lamp, and an incandescent lamp. The size of the connecting device 114 and the cover 118 may be designed to be applicable to lamps of various standard or non-standard sizes.

It can be seen from the foregoing embodiments that, by use of the replaceable active cooling module of the present application, only the active cooling device, rather than the whole lamp, needs to be replaced when the service life of the active cooling device is reached, thus reducing the costs.

Although the present invention has been described with reference to specific embodiments, persons skilled in the art may understand that many modifications and variations can be made to the present invention. It is, therefore, to be understood that the appended claims are intended to cover all such modifications and variations insofar as they are within the concept and scope of the invention.

What is claimed is:

1. A light emitting diode (LED) lamp, comprising:

a base configured to electrically connect with an external power supply;

at least one first printed circuit board (PCB), with at least one LED mounted thereon;

a driver module, electrically connected to the base and the first PCB, and configured to drive the LED;

a heat dissipation module, thermally contacted with the first PCB, and configured to dissipate heat generated from the LED;

a connecting device, connected to the heat dissipation module; and a replaceable active cooling module, detachably connected to the connecting device, and configured to generate a cooling fluid for cooling at least one of the PCB and the heat dissipation module; and wherein the replaceable active cooling module comprises:

at least one active cooling device configured to generate a cooling fluid for cooling at least one of the PCB and the heat dissipation module; and a cover configured to accommodate the at least one active cooling device, the cover configured to rotatably disengage the connecting device to facilitate detachment of the replaceable active cooling module from the connecting device, wherein the at least one active cooling device is mounted to the cover, and wherein the rotatable disengagement of the cover from the connecting device causes the replaceable active cooling module to disengage from the connecting device.

2. The LED lamp according to claim 1, wherein the at least one active cooling device comprises at least one of a fan, an air jet pump and a jet cooler.

3. The LED lamp according to claim 1, wherein the connecting device and the cover are connected through at least one connection type selected from a clip connection, a screw connection, a thread connection and an interference fit connection.

4. The LED lamp according to claim 1, further comprising at least a second PCB mounted between the active cooling device and the cover, wherein the second PCB is electrically connected with the first PCB through a first electrical connector selected from detachable electrical connectors, and the second PCB has at least one light emitting diode (LED) mounted thereon.

5. The LED lamp according to claim 1, wherein the replaceable active cooling module is electrically connected with the first PCB through a second electrical connector selected from detachable electrical connectors.

6. The LED lamp according to claim 1, further comprising a base housing, with one end thereof connected to the base, and the other end thereof configured to connect with the driver module and the heat dissipation module, wherein the heat dissipation module is positioned between the base housing and the connecting device.

7. The LED lamp according to claim 6, further comprising a lamp housing between the base housing and the connecting device.

8. The LED lamp according to claim 1, wherein the at least one first PCB comprises a plurality of first PCB arranged around the heat dissipation module.

9. The LED lamp according to claim 1, further comprising a control module mounted on the replaceable active cooling module, wherein the control module comprises at least one of a solar sensor, a motion sensor, a human sensor, an acoustic sensor, a temperature sensor, a humidity sensor, an air quality sensor and a wireless module.

* * * * *